US009564284B2

(12) United States Patent
Gerzoskovitz et al.

(10) Patent No.: US 9,564,284 B2
(45) Date of Patent: Feb. 7, 2017

(54) ANODE HAVING A LINEAR MAIN EXTENSION DIRECTION

(75) Inventors: Stefan Gerzoskovitz, Garmisch Partenkirchen (DE); Hannes Lorenz, Ehenbichl (AT); Jürgen Schatte, Reutte (AT); Hannes Wagner, Reutte (AT); Andreas Wucherpfennig, Reutte (AT)

(73) Assignee: Plansee SE, Reutte (AU)

( * ) Notice: Subject to any disclaimer, the term of this patent is extended or adjusted under 35 U.S.C. 154(b) by 248 days.

(21) Appl. No.: 14/237,254

(22) PCT Filed: Aug. 2, 2012

(86) PCT No.: PCT/AT2012/000204

§ 371 (c)(1),
(2), (4) Date: Feb. 18, 2014

(87) PCT Pub. No.: WO2013/020151

PCT Pub. Date: Feb. 14, 2013

(65) Prior Publication Data

US 2014/0211924 A1 Jul. 31, 2014

(30) Foreign Application Priority Data

Aug. 5, 2011 (AT) ..... GM446/2011 U

(51) Int. Cl.
*H01J 35/12* (2006.01)
*H01J 9/14* (2006.01)

(52) U.S. Cl.
CPC ..... *H01J 35/12* (2013.01); *H01J 9/14* (2013.01); *H01J 2235/068* (2013.01); *H01J 2235/084* (2013.01); *H01J 2235/086* (2013.01)

(58) Field of Classification Search
USPC ..... 378/9, 19, 4, 126, 134, 143
See application file for complete search history.

(56) References Cited

U.S. PATENT DOCUMENTS 4,670,895 A * 6/1987 Penato ..... H01J 35/101 378/125
6,553,096 B1 * 4/2003 Zhou ..... A61B 6/4488 378/122

(Continued)

FOREIGN PATENT DOCUMENTS

DE 2822241 A1 12/1978
DE 19828956 A1 10/1999

(Continued)

OTHER PUBLICATIONS

Austrian Patent Office Search Report Dated Jul. 10, 2012.

*Primary Examiner* — Phillip A Johnston
*Assistant Examiner* — Hsien Tsai
(74) *Attorney, Agent, or Firm* — Laurence A. Greenberg; Werner H. Stemer; Ralph E. Locher

(57) ABSTRACT

An anode with a linear main direction of extent for an x-ray device, has an anode body and a focal track layer, which is connected to the anode body in a material-bonding manner on a focal track layer volume portion of the anode body. At least one cooling channel for the cooling of the anode body and the focal track layer is arranged in the interior of the anode body and at least the focal track layer volume portion is formed of a material with at least a basic matrix of refractory metal. The focal track layer volume portion extends as far as to the cooling channel.

14 Claims, 5 Drawing Sheets

(56) References Cited

U.S. PATENT DOCUMENTS

| | | | | |
|---|---|---|---|---|
| 7,349,525 | B2 | 3/2008 | Morton et al. | |
| 8,559,592 | B2 | 10/2013 | Betcke et al. | |
| 8,576,988 | B2 | 11/2013 | Lewalter et al. | |
| 2009/0285362 | A1* | 11/2009 | Birnbach | A23L 3/263 378/122 |
| 2010/0008471 | A1* | 1/2010 | Morton | G21K 1/02 378/141 |
| 2012/0300901 | A1* | 11/2012 | Lewalter | A61B 6/4028 378/22 |

FOREIGN PATENT DOCUMENTS

| | | | |
|---|---|---|---|
| JP | 2002329470 | A | 11/2002 |
| JP | 2003290208 | A | 10/2003 |
| JP | 2006524892 | A | 11/2006 |
| WO | 2010007375 | A2 | 1/2010 |
| WO | 2011033439 | A1 | 3/2011 |

* cited by examiner

ANODE HAVING A LINEAR MAIN EXTENSION DIRECTION

BACKGROUND OF THE INVENTION

Field of the Invention

The present invention relates to an anode with a linear main direction of extent for an x-ray device and to a method for producing an anode with a linear main direction of extent for an x-ray device.

Anodes for x-ray devices are known in principle. They are used to interact with a cathode to emit x-radiation by electron bombardment. For this, known anodes are, for example, used in interaction with the cathode in computed tomography scanners or baggage x-ray machines. The known anodes of such x-ray devices are usually configured as a fixed stationary anode with a focal spot or as a rotating anode with a focal track. Stationary anodes serve the purpose of being bombarded with an electron beam as fixed components and subsequently emitting the desired x-radiation. In the case of rotating anodes, a focal track layer is provided, arranged in a rotating manner on a disk. As a result of the rotation of the disk, it is only ever part of the focal track layer that is hit by the electron beam, so that the remaining region of the focal track layer can cool down.

A disadvantage of known anodes for x-ray devices is that they necessitate a relatively complex construction if a high resolution is to be achieved at high levels of energy. Then either stationary anodes or rotating anodes are necessary, such rotating anodes also along with the rotation being additionally mechanically movable over a certain range. In the case of computed tomography scanners, three-dimensional recording of x-ray images in particular is desired, so that not only the rotating anode itself moves in a rotating manner, but also the entire x-ray device must be movable. The mechanical components necessary for this, which are necessary for the relative movement, are on the one hand very noisy in operation and on the other hand susceptible to faults.

It has already been proposed to use as anodes for x-ray devices so-called linear extents for the anodes. This makes it possible for a reduction in the mechanically moving parts to be achievable. However, even in the case of a linear extent, known anodes have the disadvantage that they allow very short focal tracks or only short focal track segments. Otherwise, that is to say with longer focal tracks, there would be the risk of the connection of the focal track layer to the anode bending or crazing. In particular at the high operating temperatures to be expected in the case of computed tomography scanners or baggage scanners of up to 3000°, the risk of bending or crazing is high. Thus, although in such a case a lower degree of mechanical complexity could be achieved, a large number of short focal track segments would be necessary. Apart from the increase in production complexity there would be for the many individual segments of the focal track, in this way there would also be the problem of the overlapping of individual focal track segments, which is in principle contrary to unconstrained positioning of the focal track spot.

BRIEF SUMMARY OF THE INVENTION

An object of the present invention is to at least partially eliminate the disadvantages described above of known anodes. In particular, an object of the present invention is to provide an anode with a linear main direction of extent for an x-ray device and a method for producing such an anode with the aid of which even long focal tracks can be achieved with a high degree of mechanical stability. In particular, this aim should be achieved in a low-cost and easy way.

The aforementioned object is achieved by an anode with a linear main direction of extent and by a method for producing an anode. Further features and details of the invention are provided by the sub claims, the description and the drawings. It goes without saying here that features and details that are described in conjunction with the anode according to the invention also apply in conjunction with the method according to the invention and vice versa, so that, with respect to the disclosure of the individual aspects of the invention, reference is or can always be made from one to the other.

An anode according to the invention with a linear main direction of extent for an x-ray device has an anode body and a focal track layer, which is connected to the anode body in a material-bonding manner on a focal track layer volume portion of the anode body. Such an anode according to the present invention may also be referred to as an x-ray anode with a linear main direction of extent. An anode according to the invention is distinguished by the fact that at least one cooling channel for the cooling of the anode body and the focal track layer is arranged in the interior of the anode body and at least the focal track layer volume portion consists of a material with at least a basic matrix of refractory metal. Furthermore, it is provided in the case of an anode according to the invention that the focal track layer volume portion extends as far as to the cooling channel.

In the case of an anode according to the invention, a linear main direction of extent should be understood as meaning a direction of extent that runs along a straight line or along a curved line. In other words, the anode may, for example, be formed essentially in the form of a bar, this bar having a cuboidal form. A cuboid that has a curvature over at least part of its profile is also considered to be an anode with a linear main direction of extent within the scope of the present invention. The anode is in this case in particular a static anode, which is not configured as rotating but possibly movable. It therefore differs explicitly from a known rotating anode. It also differs from a purely static anode with a focal spot, since a focal track layer that produces a large number of focal spots is provided on the anode. Such an anode can be used, for example, with a large number of cathodes, as can be provided, for example, by so-called Carbon Nano Tubes (CNT). The movable configuration of the anode is particularly on a small scale, so that small compensating displacements or angular changes of the anode can be produced by such mobility.

In the case of an anode according to the invention, the material bonding may be achieved in various ways. In principle, it is possible that the focal track layer is configured as bonding directly with the material of the focal track layer volume portion. This would be achieved, for example, by melting and fusing of the focal track layer. It goes without saying that it is also possible for one or more layers to achieve the desired material bond. For example, a brazed connection would produce one or more such layers as a material bond. If more than one layer is used for the material bond, it is significant that each of these layers is in material-bonding connection with the neighboring layer, or with the focal track layer and/or the focal track layer volume portion. In such a case, there would therefore be a material bonding cascade.

In the case of an anode according to the invention, it is possible that the focal track layer is configured in particular as a single focal track layer. According to the invention, the focal layer is in this case preferably formed in an unsegmented way, so that a focal track layer that is essentially as long as desired can be created. By contrast with the problems encountered in the case of known anodes with a linear main direction of extent, there is in principle no limitation here of the length of the focal track layer. This is achieved by a basic matrix of refractory metal being provided for the material of the focal track layer volume portion. This has the effect that a high melting point of the focal track layer volume portion is accompanied by a high melting point of the focal track layer itself. Since a high melting point for a material is also accompanied by a low thermal expansion, that is to say a low coefficient of thermal expansion, the coefficient of thermal expansion of the focal track layer volume portion and of the focal track layer are brought closer together by being formed according to the invention. In other words, the two coefficients of thermal expansion differ only very little, in particular in percentage terms.

Thus, if an anode formed according to the invention is used, the focal track layer heats up as a result of the bombardment with electrons. This heating up has the effect that, as a result of the downward removal of the heat, the focal track layer volume portion lying thereunder also heats up. This heating up is accompanied by a thermal expansion of the focal track layer and of the focal track layer volume portion. However, on account of the configuration according to the invention, this respective thermal expansion is similar or differs only slightly in relation to one another.

The provision of a material with at least a basic matrix of refractory metal for the focal track layer volume portion has the effect of producing an anode of which the differences in the thermal expansion between the focal track layer and the focal track layer volume portion are only very small. On account of the little difference there is in the thermal expansion, the consequent interlaminar stress is also reduced. Since such an interlaminar stress can be seen as one of the reasons for bending of the anode, and for the crazing of the connecting region between the focal track layer and the focal track layer volume portion, this risk is reduced or minimized by the present invention. This reduction of the risk of crazing and bending allows the focal track layer to be configured with a much longer extent in the case of an anode according to the invention. In comparison with known anodes, individual focal track layers that are a meter long, or even a number of meters long, can also be achieved in the case of an anode according to the invention.

In the case of an anode according to the invention, the difference in the thermal expansion with respect to the material of the focal track layer and the material of the focal track layer volume portion is less than $5\times10^{-6}$ 1/K, in particular less than $2\times10^{-6}$ 1/K. These particularly small differences in the thermal expansion lead to particularly small interlaminar stresses as a result of the material-bonding connection between the focal track layer and the focal track layer volume portion.

The material of the focal track may, for example, at least primarily comprise molybdenum or tungsten. In particular, it is a tungsten-based alloy. For example, this may be understood as meaning an alloy that comprises over 50 percent by weight of tungsten. A further constituent of such an alloy may be, for example, rhenium.

Within the scope of the present invention, the term a "refractory metal" should be understood as meaning in particular a metal of which the melting point lies above 2000° C. The materials both for the focal track layer and for the focal track layer volume portion, in particular at least a basic matrix thereof, are preferably recrystallized materials.

Within the scope of the present invention, the cooling channel may be a simple bore, but may also be a more complex configuration. Thus, for example, it is possible that the cooling channel is bounded by a separate wall, which lies against the anode body. It is also possible that such a tube for forming the wall is produced, for example, from a different material, such as possibly copper or steel. It goes without saying that tubes of materials that correspond to the material of the anode body, in particular of the focal track layer volume portion, are also conceivable. It is also advantageous if the walls themselves are formed in one piece with the anode body and/or the focal track layer volume portion.

An anode according to the invention may be developed in such a way that the anode body is monolithically formed. A monolithic form should be understood as meaning production from a single piece of material. Particularly compact and particularly seal-tight production can be achieved thereby, in particular with regard to the cooling channel. In addition, no additional steps of connecting individual components have to be carried out for the anode body. This also means that the focal track layer volume portion is a monolithic component part of the anode body. In this case, in spite of the monolithic embodiment, a different configuration of the material of the focal track layer volume portion may be provided in comparison with the rest of the anode body.

In the case of multi-part anode bodies, in particular the part which has the focal track layer volume portion and in which the cooling channel runs is a monolithic part. Apart from the extremely low degrees of production complexity with regard to the individual production steps and possible machining operations, in this way it is possible to create a composite that produces particularly low interlaminar stresses. In addition, the monolithic form makes it possible to dispense with quality control with regard to the possible types of connection between otherwise necessary individual components.

It is also advantageous if, in the case of an anode according to the invention, the focal track layer volume portion and the focal track layer consist of the same material. The same material both for the focal track layer and for the focal track layer volume portion is accompanied by the advantage that there are no longer any differences, or essentially no differences, with regard to the coefficient of thermal expansion of the two materials. The two components adjoining one another, which are in material-bonding connection with one another, are consequently without any difference with regard to their thermal expansion. Therefore, possibly occurring interlaminar stresses between these components only result from possible differences in temperature, which however turn out to be much less than would be the case with different coefficients of thermal expansion of different materials. In addition, a temperature varies with an essentially continuous distribution over the different components. Sudden changes in temperature, and consequently abrupt changes in expansion, between individual components are avoided in this way. Such an embodiment may be described as a particularly advantageous state, in particular as an ideal state.

It is a further advantage if, in the case of an anode according to the invention, the anode body consists essentially of a single material, that is to say the material of the focal track layer volume portion. In other words, an embodiment of the anode body that is not only monolithic but also made from one and the same material is required here in the case of this embodiment. This further simplifies production, since the entire anode body can be produced from a single piece of material. An anode according to the invention, in particular the anode body, can be produced either by being built up and/or by being machined by milling and/or drilling. Apart from production, an advantage is also achieved in operation. In this way, no interlaminar stresses are possible in the material of the anode body, since it is formed from one and the same material. It is pointed out here in particular that, in spite of being formed from a single material, it may also take a multi-part form. By contrast with a monolithic embodiment, which is also possible in the case of a single material, a multiplicity of individual components for the anode body that are subsequently connected to one another, in particular in a material-bonding manner, may also be produced from a single material. The material-bonding connection of the individual components is in this case performed, for example, by welding or brazing of the individual components. In particular, further connection parts, such as for example terminating plugs or connection bushes, are in this case preferably not monolithically formed, but are part of the anode body. They, too, may consist of the same material as the focal track layer volume portion.

It may likewise be of advantage if, in the case of an anode according to the invention, the focal track layer and the anode body are monolithically formed. For example, all of the materials of the focal track layer and of the anode body are formed from tungsten, for example comprise a tungsten-based alloy as the basic matrix. This embodiment is accompanied by the effect that the focal track layer and the anode body create the desired material bond by the monolithic embodiment, and moreover one and the same material is preferably used for everything. Apart from the still further simplified production, this provides an ideal state with regard to the interlaminar stresses occurring between the individual components, that is to say the focal track layer volume portion, the rest of the anode body and the focal track layer itself.

It is a further advantage if, in the case of an anode according to the invention, the anode body is configured at least as two parts, the individual parts extending along the main direction of extent of the focal track layer and being connected to one another in a material-bonding manner. In the case of this configurational variant, curved anodes, that is to say an anode that is oriented on a curved line along its linear main direction of extent, can be produced at particularly low cost. For example, two half-shells may be produced, with a milled recess being made in their respectively opposing contact areas to create the cooling channel. Alignment possibilities for the individual components in relation to one another are also possible, in order to connect the individual components of the anode body to one another. The connecting is preferably performed by a material-bonding method, such as for example by a brazing or welding operation.

It is likewise of advantage if, in the case of an anode according to the invention, the cooling channel is formed by at least two parts of the anode body. In this way, an even freer geometry of the channel is possible. In particular, the explicit position of the channel within the anode body, and also the course of the cooling channel and possible variations of the cross section of the cooling channel are possible as a result of this embodiment by corresponding control of the milling operation during the production of the cooling channel.

It may be a further advantage if, in the case of an anode according to the invention, the cooling channel is formed in the anode body in a vacuum-tight manner. In the case of such an embodiment, the cooling channel is as it were formed directly. Further sealing, such as for example by separate tubes or pipes, is not required. There is therefore no need for subsequent working to create the vacuum tightness. Within the scope of the present invention, "vacuum-tight" should lead a cooling channel which, on the basis of the method of measurement specified by DIN EN 13185, has according to the measuring procedures of Group A a helium leakage rate that is less than or equal to $1\times10^{-8}$ mbar/s. In this way, the cooling channel can be formed at low cost and directly to carry a cooling fluid. It goes without saying that further connection possibilities, such as for example connection bushes, to introduce the coolant into the cooling channel in the desired way or to remove it again from this cooling channel, can additionally be provided.

It is likewise of advantage if, in the case of an anode according to the invention, the anode body has at least in the region of the focal track layer volume portion a side face adjusted at an acute angle, on which the focal track layer is at least partially arranged. The acute-angled adjustment thereby allows even better arrangement in the x-ray apparatus. In particular, in this way the attachment in the x-ray device can be freely chosen, since the acute-angled adjustment of the side face allows the alignment of the focal track layer. In this case, the alignment of the acute angle is preferably such that, when the anode is arranged in the x-ray device in the desired direction, the x-radiation emerges with the highest intensity. This is the case in particular in the range of 7 to 15°, taken from the focal track layer.

It may also be of advantage if, in the case of an anode according to the invention, the focal track layer volume portion consists of one of the following materials:

- tungsten,
- molybdenum,
- a tungsten-based alloy with more than 50% by weight of tungsten,
- a molybdenum-based alloy with more than 50% by weight of molybdenum,
- a tungsten-based composite with more than 50% by weight of tungsten,
- a molybdenum-based composite with more than 50% by weight of molybdenum.

A composite that is of a tungsten-based or molybdenum-based form should be understood as meaning in particular the composite with another metal. The other metal may be, for example, a metal with a high thermal conductivity, such as for example copper. In other words, pores in a basic tungsten matrix or a basic molybdenum matrix, or a different type of refractory metal as the basic matrix are used for filling with another metal. In other words, in this way heat conducting channels that allow improved heat removal from the focal track layer to the cooling channel can be produced. At the same time, however, the basic matrix of the refractory metal is given the advantages such as have already been described in the introductory part of this invention with regard to the less bending and the reduction in the risk of crazing of the material-bonding connection between the focal track layer volume portion and the focal track layer. The pores sizes in the case of a composite preferably lie between 2 and 100 μm, in particular between 2 and 50 μm. Such a pore size serves the purpose that an adequate removal of heat is possible through correspondingly incorporated metals, and at the same time the necessary heat resistance is achieved with regard to the melting point and with regard to the coefficient of thermal expansion.

It is a further advantage if, in the case of an anode according to the invention, at most one interlayer is arranged to create the material-bonding connection between the focal track layer and the focal track layer volume portion. This interlayer is both connected to the focal track layer in a material-bonding manner and connected to the focal track layer volume portion in a material-bonding manner. An example of an interlayer that is connected in a material-bonding manner is a brazing metal. This may establish the material bond with the focal track layer, and with the focal track layer volume portion, by brazing methods.

By having at most one interlayer, a possible thermal insulation by such an interlayer is reduced. It is ensured that, in spite of the arrangement of this interlayer for the material-bonding connection, removal from the focal track layer of the heat produced by the electron bombardment is possible as quickly and effectively as possible. In addition, the complexity of an anode according to the invention is reduced, since only the application of a single interlayer is necessary. Since a refractory metal is used at least as the basic matrix for the focal track layer volume portion, by contrast with the high expenditures incurred in the case of rotating anodes there is no longer any need for step-by-step adaptation of the temperatures over a large number of interlayers. Apart from the low degree of complexity, here it is also possible to save volume, weight and especially the time expended in production.

It is likewise advantageous if, in the case of an anode according to the invention, at least one portion of the wall of the cooling channel is aligned parallel or essentially parallel to the focal track layer. This means that, at least in certain sections, the portion of the wall of the cooling channel runs along the main direction of extent of the anode. Consequently, the distance of at least this portion of the wall of the cooling channel from the focal track layer portion is kept essentially constant over the width and over the length of the focal track layer. This ensures that an essentially constant removal of heat from the focal track layer is made possible over the entire course of the focal track layer. This serves the purpose of avoiding individual hot spots, in order to ensure that the focal track layer allows constant and essentially continuous aging during use over the entire course of the focal track layer.

It should be pointed out in this respect that the cooling channel may have different embodiments. In particular with regard to its free flow cross section, it must in this case be adapted to the necessity of the fluid flow of the cooling fluid. Not only round, half-round and rectangular but also square or differently shaped opening cross sections are conceivable for the cooling channel. Apart from the necessary flow conditions inside the cooling channel, consideration is preferably also to be given to the production methods that are correspondingly to be used.

As an alternative to a completely parallel form of the channel, it is also possible that the channel runs along the length of the focal track layer at an ever decreasing distance. Since the cooling fluid inside the cooling channel absorbs heat over the course of the cooling channel, the difference in heat with respect to the focal track layer will decrease over the course of the cooling channel. Thus, in order nevertheless to achieve essentially constant cooling or an essentially constant temperature for the focal track layer, the variation in distance between the cooling channel and the focal track layer allows an essentially constant temperature of the focal track layer to be achieved by varyingly intense heat removal.

It is a further advantage if, within the scope of the present invention, the cooling channel of the anode is formed for directly carrying a cooling fluid. The cooling fluid is in this case preferably a liquid. The channel is therefore formed in a correspondingly seal-tight manner, in particular liquid-tight, so that additional sealing is no longer necessary. In particular, an inner tube or inner pipe can be prevented in this way. The reduction in complexity is accompanied by cost advantages in production and in material selection. In addition, possible interlaminar stresses between additionally necessary materials of the otherwise additionally necessarily seals are avoided in the case of this embodiment. The wall of the cooling channel is therefore already a component part of the anode body or a component part of the focal track layer volume portion.

It is likewise advantageous in the case of an anode according to the invention if the focal track layer has a length which is greater than twice the width of the focal track layer. In particular, lengths of 20 to 1500 mm are advantageous here. In particular, the great lengths of over one meter are advantageous for a focal track layer, since, in spite of the production complexity, a particularly large anode can be produced according to the present invention.

Consequently, according to the present invention, even just a few anodes can make a particularly expansive area possible for x-ray monitoring or for the creation of x-ray images. In the case of a computed tomography scanner, which is intended to create 360° x-ray images in three-dimensional imaging processes, it is sufficient for example if four such anodes according to the invention, each with a curvature of 90°, cover the peripheral extent of such a computed tomography scanner. The necessary overlaps at the joins between the individual anodes are thereby minimized, so that higher resolutions are achievable, with at the same time low-cost production of the anode. The width of a focal track layer according to the invention is, for example, 10 to 20 mm. The factors regarding the length of the focal track layer are preferably greater than twice the width, in particular greater than five times the width, preferably greater than ten times the width of the focal track layer. The main advantages of the present invention are achieved in particular if the length of the focal track layer is one hundred times or even one hundred and fifty times the width of the focal track layer.

The present invention also concerns a method for producing an anode with a linear main direction of extent for an x-ray device, having the following steps:

forming a cooling channel in an anode body, placing a focal track layer on a side face of a focal track layer volume portion of the anode body that consists of a material with at least a basic matrix of refractory metal and extends as far as to the cooling channel and connecting at least the focal track layer to the focal track layer volume portion in a material-bonding manner.

The above method is used in particular for creating an anode according to the invention. Following the material-bonding connection, or already before that, a curvature may be created when forming a cooling channel according to the invention, so that it is also possible with a method according to the invention to achieve an anode with a linear main extent, the main direction of extent extending along a straight line or along a linear path of curvature. Further connection parts may subsequently be implemented, for example by a material-bonding method, or at the same time during the material-bonding connection of at least the focal track layer. Examples of such connection parts are connection bushes for the cooling fluid or connection plugs for openings in the anode body. A method according to the invention leads to an anode according to the invention, so that it is also possible by a method according to the invention to achieve the advantages such as have been explained in detail with reference to an anode according to the invention.

The present invention is explained in more detail on the basis of the accompanying figures of the drawing. The terms used thereby, "left", "right", "up" and "down", relate to an alignment of the figures of the drawing with the reference numerals as they can normally be read. In the drawing:

DESCRIPTION OF THE INVENTION

Figure 1:
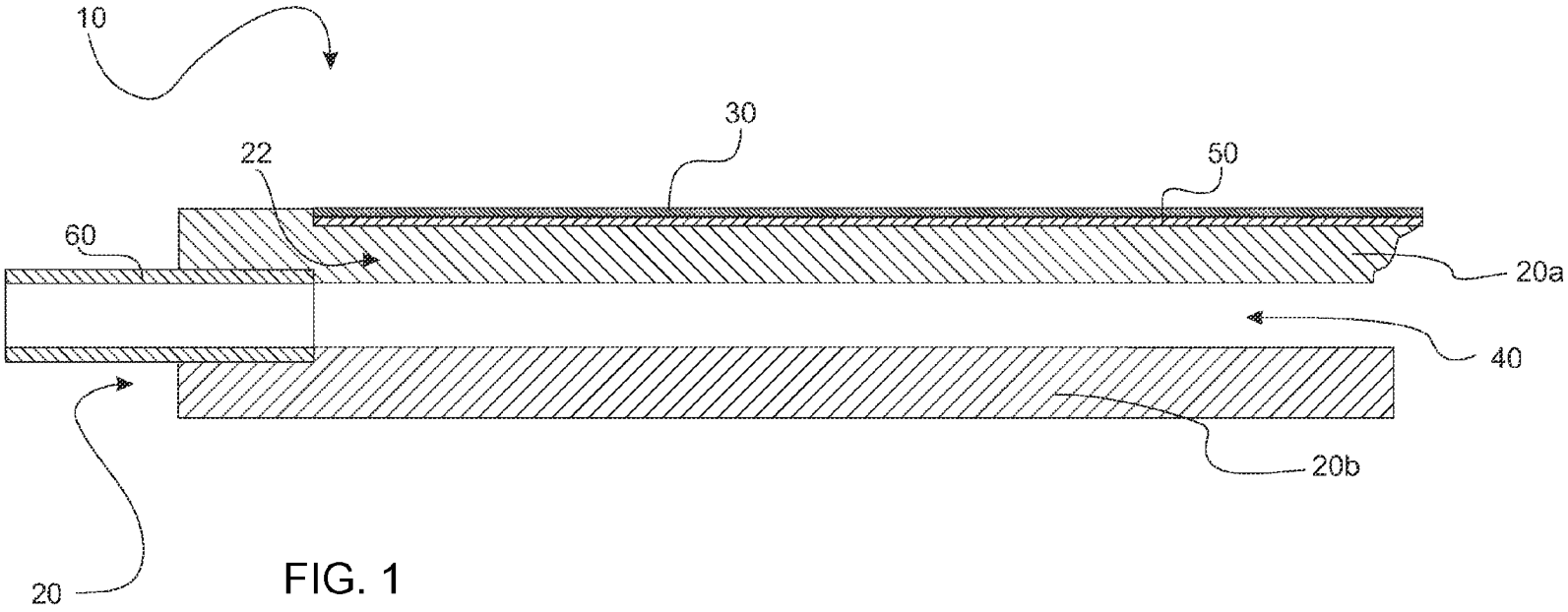
FIG. 1 shows a first embodiment of an anode according to the invention in a schematic cross section.

In FIG. 1, a first embodiment of an anode -10- according to the invention is represented in a schematic cross section. Here it can be seen well that this embodiment concerns an anode body -20- with two parts -20*a*- and -20*b*-. The first part -20*a*- of the anode body -20- has in this case the focal track layer volume portion -22-. Connected to this focal track layer volume portion -22- in a material-bonding manner is the focal track layer -30-. Between the focal track layer -30- and the focal track layer volume portion -22-, a single interlayer -50- is provided. This single interlayer -50- is configured as a brazed layer and is connected both to the focal track layer -30- and to the focal track layer volume portion -22- in a material-bonding manner.

It can also be seen in FIG. 1 that both the interlayer -50- and the focal track layer -30- are recessed in the anode body -20-, in particular the first part -20*a*- of the anode body -20-. Since the focal track layer -30- is under a very high electrical voltage, the recessed arrangement prevents a voltage flashover, that is to say an arc, at the edges of the focal track layer -30-.

In the case of the embodiment of FIG. 1, the cooling channel -40- is formed between the two parts -20*a*- and -20*b*- of the anode body -20-. Such a form is explained in still more detail later with reference to FIGS. 2*a*, 2*b* and 2*c*. In addition, the cooling channel -40- is provided with a connection -60- for the connection to an external coolant supply. This connection -60- is an inserted bush, which is, for example, connected by a material-bonding connecting method to at least one or both parts -20*a*- and -20*b*- of the anode body -20-. This material-bonding connection in particular likewise is achieved by a brazing method. It goes without saying that, in other geometries, the connection -60- may also protrude in other directions, for example may lead into the cooling channel -40- from below. An application-specific alignment is performed in particular here, so that the connection -60- is set with respect to the space requirement during the operation of the anode -10- according to the invention.

Figure 2B:
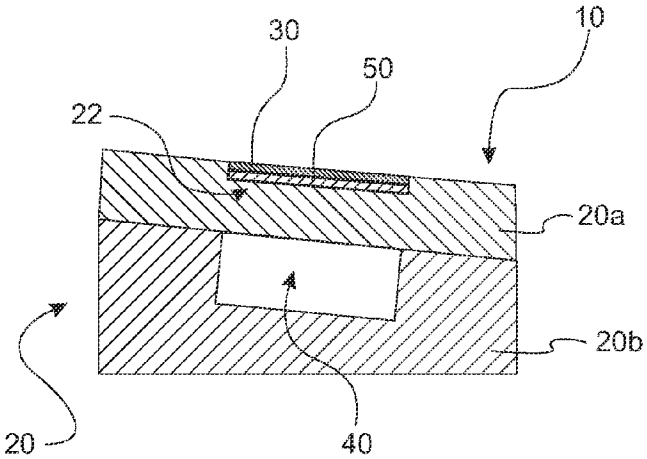
FIG. 2*b* shows a further embodiment of an anode according to the invention in a schematic cross section.
Figure 2A:
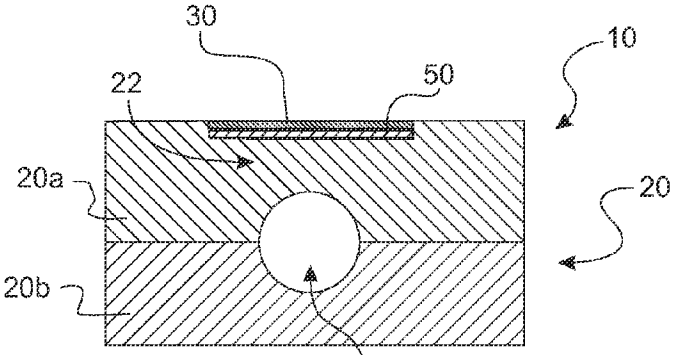
FIG. 2*a* shows an embodiment of an anode according to the invention in a schematic cross section.
Figure 2C:
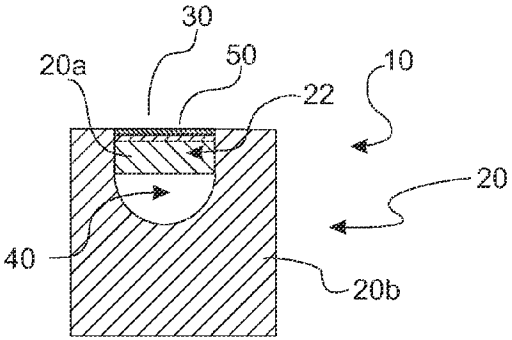
FIG. 2*c* shows a further embodiment of an anode according to the invention in a schematic cross section.

FIGS. 2*a* to 2*c* show three different variants of how the anode body -20- can be put together to form the cooling channel -40-. A common feature of all of these variants is that, as in the case of the embodiment of FIG. 1, the focal track layer -30- is connected to the focal track layer volume portion -22- in a material-bonding manner by way of a single interlayer -50-. In the case of all three of these variants, the anode body -20- is respectively formed in a multi-part manner, in particular a two-part manner, from a first part -20*a*- and a second part -20*b*-.

In the case of FIG. 2*a*, the cooling channel is formed by both parts -20*a*- and -20*b*- of the anode body -20-. In the case of this embodiment, the cooling channel -40- has a round flow cross section, so that a half-round free cross section is formed in each case in the respective part -20*a*- and -20*b*- of the anode body -20-. In the case of this embodiment, the first part -20*a*- is preferably produced completely from the material of the focal track layer volume portion, that is to say in particular a tungsten- or molybdenum-based alloy. The second part -20*b*- of the anode body -20-, which terminates underneath the cooling channel, may also be produced from a low-cost material, for example high-grade steel or copper.

Also in FIG. 2*b*, a two-part embodiment of the anode body -20- is shown. Here, however, the cooling channel -40- is only formed in the lower part -20*b*- of the anode body -20-. This has the advantage that machining or other formation of the cooling channel -40- only has to be performed in one of the two parts -20*a*- and -20*b*- of the anode body -20-. This reduces the depth of production for such an anode -10- according to the invention. In order to cover the cooling channel -40-, the first part -20*a*- is placed onto the second part -20*b*-. As also in the case of the embodiment of FIG. 2*a*, the two parts -20*a*- and -20*b*- of the anode body -20- are connected to one another in a material-bonding manner, for example by a brazing method. In this way, the cooling channel -40- is configured in an essentially completely vacuum-tight form, so that it can in particular be used directly, that is to say without further introduction of an additional pipe as a wall, for the transporting of cooling fluid.

FIG. 2*c* shows an embodiment of an anode -10- according to the invention, in which the cooling channel -40- has a semicircular cross section. In the case of this embodiment, the focal track layer volume portion -22- is essentially the same as the first part -20*a*- of the anode body -20-. Here, too, the two parts -20*a*- and -20*b*- are connected to one another in a material-bonding manner, so that a vacuum-tight termination of the cooling channel -40- is achieved. In the case of this embodiment, the refractory metal is reduced to a minimum, at least as a basic matrix for the focal track layer volume portion -22-, with regard to the extent over the volume. This accordingly also reduces the correspondingly necessary costs for the anode -10- as a whole, since, for example, a lower-cost material can be used for the second part -20*b*-.

Figure 3:
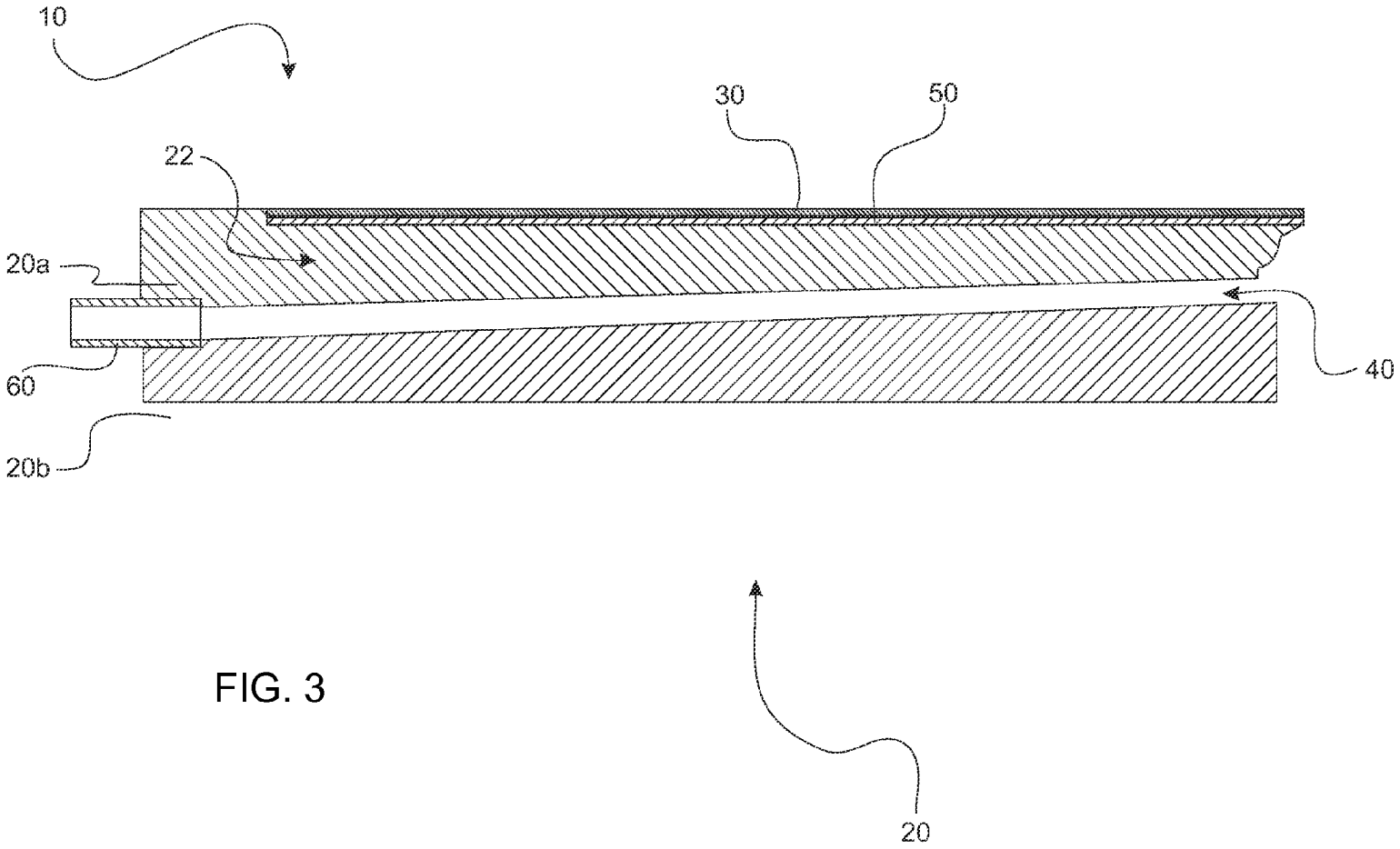
FIG. 3 shows a further embodiment of an anode according to the invention in a schematic cross section.

In FIG. 3, a further embodiment of an anode -10- according to the invention is represented. This embodiment differs from FIG. 1 in that the cooling channel -40- is not only made narrower but also in addition formed with respect to the focal track layer -30- such that it comes closer to this focal track layer -30-. Cooling fluid that enters the cooling channel -40- through the connection -60- will therefore minimize the distance from the focal track layer -30- to be cooled as it passes over the course of the cooling channel -40-. Thus, at the beginning a poorer removal of heat will take place and at the end of the cooling channel -40- an improved removal of heat will take place. Since the cooling fluid heats up over the course of the cooling channel -40-, a constant or essentially constant temperature of the focal track layer -30- can be achieved by this form.

FIGS. 4*a* to 4*d* and 5*a* to 5*c* describe two variants of the production of an anode according to the invention. In both cases, the respective focal track layer -30- and the interlayer -50- have been applied to a side face of the anode body -20-. For the sake of better overall clarity, it is not shown here that both the interlayer -50- and the focal track layer -30- are in a recess, so that, in the case of the actual product, the edges of the focal track layer -30- and of the interlayer -50- are not visible, in order to avoid an undesired arc.

Figure 4A:
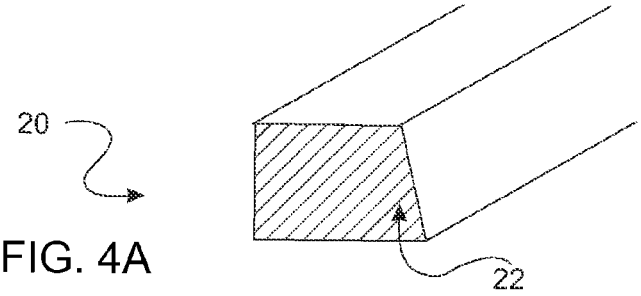
FIG. 4*a* shows an anode according to the invention during a first production step.
Figure 4B:
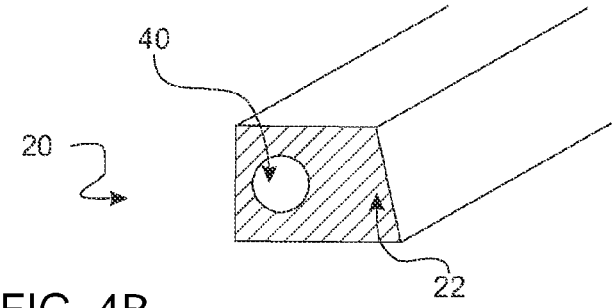
FIG. 4*b* shows the anode according to the invention according to FIG. 4*a* in a second production step.
Figure 4C:
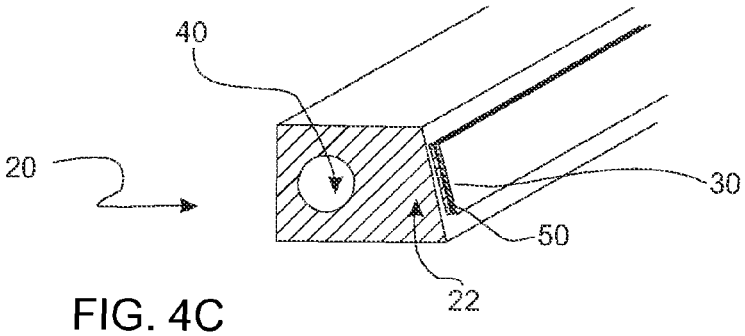
FIG. 4*c* shows the anode according to the invention according to FIG. 4*a* in a third production step.
Figure 4D:
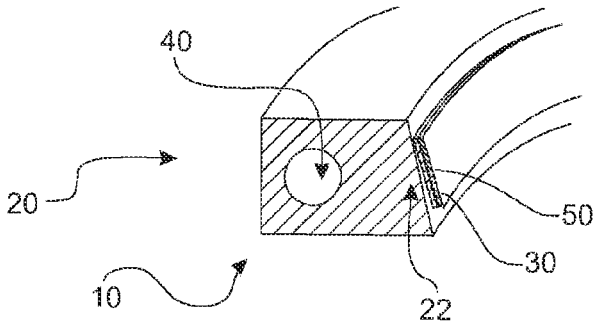
FIG. 4*d* shows an anode according to the invention according to FIG. 4*a* in a fourth production step.

FIGS. 4*a* to 4*d* show a variant of the production of an anode body -20- that has an essentially monolithic embodiment. The anode body -20- is produced from a piece of refractory metal essentially in the form of a bar. In a first step, the corresponding side faces are machined and one side face, which also at least partially forms the focal track layer volume portion -22-, is adjusted to an acute angle by milling. In the next step, as represented in FIG. 4*b*, the cooling channel -40- is created, for example by machining in the form of the use of a drilling method. Subsequently, the interlayer -50- in the form of a brazing metal and the focal track layer -30- may be placed on the focal track layer volume portion -22-, so that the material-bonding connection is established in the way according to the invention by the material-bonding connecting method, for example a brazing method. Depending on the operating situation, a curvature may subsequently be additionally created. As a result, a curved side face of the anode body -20- can be seen, with the consequence also of a curved embodiment of the focal track layer -30- and of the interlayer -50-. Consequently, even the formation of fully circumferential images of an x-ray device, such as for example in the case of a computed tomography scanner or a baggage scanning tube, can be made possible by an anode -10- according to the invention.

Figure 5A:
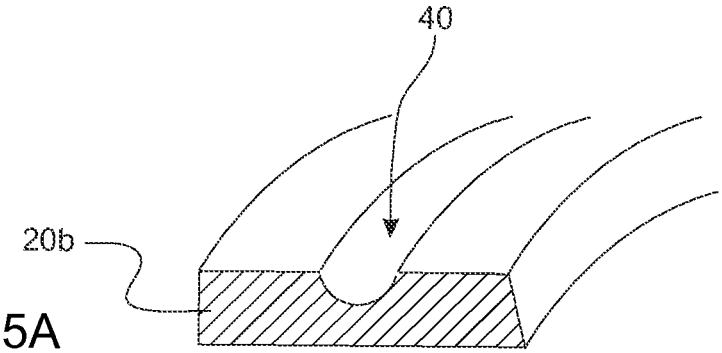
FIG. 5*a* shows a further embodiment of an anode according to the invention in a first production step.
Figure 5B:
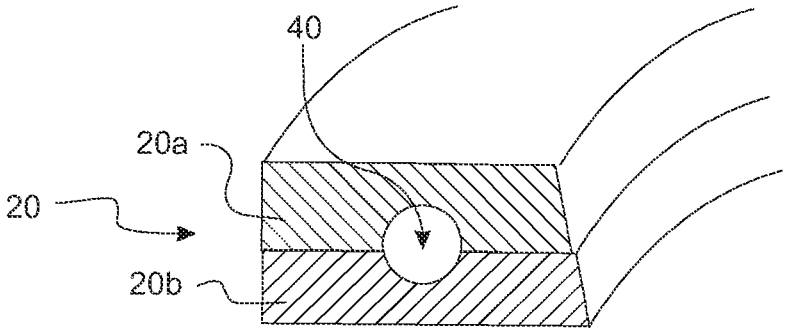
FIG. 5*b* shows the embodiment of the anode according to FIG. 5*a* in a second production step.
Figure 5C:
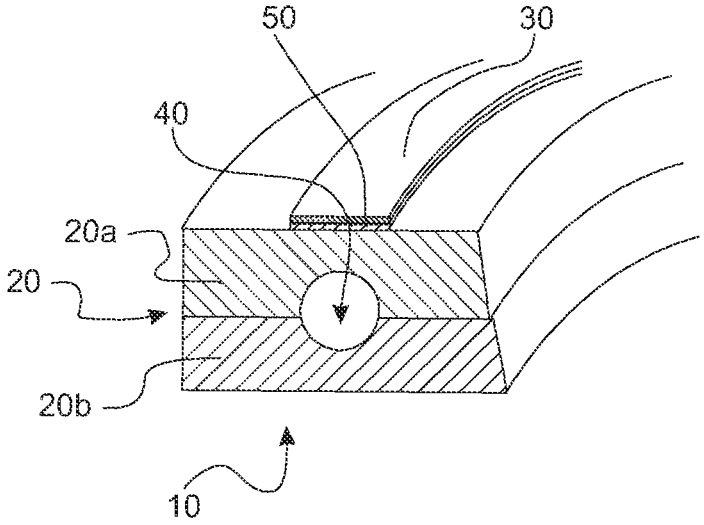
FIG. 5*c* shows the embodiment of the anode according to FIG. 5*a* in a third production step.

FIGS. 5*a* to 5*c* show a variant in which a multi-part embodiment of the anode body -20- is used for the production of the anode -10-. Here, the respective part -20*a*- and -20*b*- of the anode body -20- may be separately prefabricated, so that the cooling channel -40- can be formed in the individual parts -20*a*- and -20*b*- of the anode body -20-, for example by milling as the machining operation. Subsequently, the individual parts are put together, so that the anode body -20- is produced by a material-bonding connection of the parts -20*a*- and -20*b*-. In the case of this variant, it is additionally possible particularly easily also to introduce an inner pipe into the cooling channel -40-, since it only has to be inserted before the two parts -20*a*- and -20*b*- are connected to one another. FIG. 5*c* shows the final step, in which, in a way similar to in FIG. 4*c*, the focal track layer -30- and the interlayer -50- are placed on and formed for the material-bonding connection.

The foregoing descriptions of the individual embodiments only explain the present invention within the scope of examples. It goes without saying that, to the extent to which it is technically meaningful, features of the individual embodiments can be freely combined with one another without departing from the scope of the present invention.

LIST OF REFERENCE NUMERALS

10 Anode
20 Anode body
20*a* First part of the anode body
20*b* Second part of the anode body
22 Focal track layer volume portion
30 Focal track layer
40 Cooling channel
50 Interlayer
60 Connection

The invention claimed is:

1. An anode with a linear main direction of extent for an x-ray device, the anode comprising:

an anode body having a focal track layer volume portion formed of a material with at least a basic matrix of a refractory metal;

a focal track layer connected to said anode body in a material-bonding manner on said focal track layer volume portion of said anode body, said focal track layer having a length being greater than five times a width of said focal track layer;

at least one cooling channel for cooling said anode body and said focal track layer, said cooling channel being disposed in an interior of said anode body, said focal track layer volume portion extending as far as to said cooling channel; and said anode body having at least in a region of said focal track layer volume portion a side face adjusted at an acute angle, on which said focal track layer is at least partially disposed.

2. The anode according to claim 1, wherein said anode body is monolithically formed.

3. The anode according to claim 1, wherein said focal track layer and said focal track layer volume portion are formed of a same material.

4. The anode according to claim 1, wherein said anode body is formed of a single material.

5. The anode according to claim 1, wherein said focal track layer and said anode body are monolithically formed.

6. The anode according to claim 1, wherein said anode body is configured in at least two parts, said two parts extending along a main direction of extent of said focal track layer and being connected to one another in a material-bonding manner.

7. The anode according to claim 6, wherein said cooling channel is defined by at least said two parts of said anode body.

8. The anode according to claim 1, wherein said cooling channel is formed in said anode body in a vacuum-tight manner.

9. The anode according to claim 1, wherein said material of said focal track layer volume portion is selected from the group consisting of tungsten, molybdenum, a tungsten-based alloy with more than 50 percent by weight of tungsten, a molybdenum-based alloy with more than 50 percent by weight of molybdenum, a tungsten-based composite with more than 50 percent by weight of tungsten, and a molybdenum-based composite with more than 50 percent by weight of molybdenum.

10. The anode according to claim 1, further comprising one interlayer disposed to create a material-bonding connection between said focal track layer and said focal track layer volume portion.

11. The anode according to claim 1, wherein said cooling channel having a wall and at least one portion of said wall is aligned parallel or generally parallel to said focal track layer.

12. The anode according to claim 1, wherein said cooling channel is formed for directly carrying a cooling fluid.

13. The anode according to claim 1, wherein said anode body is formed of a single material being said material with at least said basic matrix of said refractory metal.

14. A method for producing an anode with a linear main direction of extent for an x-ray device, which comprises the steps of:

forming a cooling channel in an interior of an anode body having a focal track layer volume portion formed of a material with at least a basic matrix of a refractory metal;

placing a focal track layer on a side face of the focal track layer volume portion of the anode body and the focal track layer volume portion extending as far as to the cooling channel, the cooling channel provided for cooling the anode body and the focal track layer, the anode body having at least in a region of the focal track layer volume portion a side face adjusted at an acute angle, on the side face the focal track layer is at least partially disposed;

forming the focal track layer to have a length being greater than five times a width of the focal track layer; and connecting at least the focal track layer to the focal track layer volume portion in a material-bonding manner.

* * * * *